US005845451A

United States Patent [19]

Tolentino

[11] Patent Number: 5,845,451

[45] Date of Patent: Dec. 8, 1998

[54] TELESCOPING POLYGONAL FIGURE

[76] Inventor: Edgar Williams Tolentino, 1260 Barn Brook Rd., Virginia Beach, Va. 23454

[21] Appl. No.: 594,226

[22] Filed: Jan. 31, 1996

[51] Int. Cl.[6] ..... E04H 12/18

[52] U.S. Cl. ..... 52/646; 52/109; 52/632; 446/126; 446/487

[58] Field of Search ..... 52/109, 632, 648.1, 52/645, 646; 403/169, 170, 180, 217; 446/126, 487

[56] References Cited

U.S. PATENT DOCUMENTS

| | | | |
|---|---|---|---|
| Re. 31,641 | 8/1984 | Derus | 52/109 |
| Re. 33,710 | 10/1991 | Zeigler | 52/648 |
| 3,698,123 | 10/1972 | Heldt | 46/29 |
| 3,927,489 | 12/1975 | Bernstein | 46/29 |
| 4,083,156 | 4/1978 | Tye | 52/127 |
| 4,276,726 | 7/1981 | Derus | 52/109 |
| 4,404,240 | 9/1983 | Varela | 428/8 |
| 4,580,375 | 4/1986 | Nodstov | 52/109 |
| 4,663,899 | 5/1987 | Nodstov | 52/109 |
| 4,667,451 | 5/1987 | Onoda | 52/646 |
| 4,720,016 | 1/1988 | Kay | 211/96 |
| 4,758,196 | 7/1988 | Wang | 446/104 |
| 4,918,896 | 4/1990 | Wiese | 52/632 |
| 5,097,645 | 3/1992 | Sanderson | 52/648 |
| 5,123,550 | 6/1992 | Nodstov | 211/189 |
| 5,163,262 | 11/1992 | Adams | 52/646 |

*Primary Examiner*—Carl D. Friedman
*Assistant Examiner*—Beth Aubrey

[57] ABSTRACT

A figure for positioning into a variety of polygonal orientations. The figure includes telescoping outer members pivotally connected to one another to form a polygon. The telescoping members can each be adjusted in length and angular orientation relative to adjoining members to form a plurality of polygonal shapes.

1 Claim, 3 Drawing Sheets

TELESCOPING POLYGONAL FIGURE

BACKGROUND OF THE INVENTION

1. Field of the Invention

The present invention relates to adjustable figures and more particularly pertains to a telescoping polygonal figure for positioning into a variety of polygonal orientations.

2. Description of the Prior Art

The use of adjustable figures is known in the prior art. More specifically, adjustable figures heretofore devised and utilized are known to consist basically of familiar, expected and obvious structural configurations, notwithstanding the myriad of designs encompassed by the crowded prior art which have been developed for the fulfillment of countless objectives and requirements.

Known prior art adjustable figures include U.S. Pat. No. 5,156,700; U.S. Design Pat. No. 242,933; U.S. Design Pat. No. 267,240; U.S. Pat. No. 4,137,535; U.S. Pat. No. 4,358,773; and U.S. Pat. No. 3,928,854.

While these devices fulfill their respective, particular objectives and requirements, the aforementioned patents do not disclose a telescoping polygonal figure for positioning into a variety of polygonal orientations which includes telescoping outer members pivotally connected to one another to form a polygon, wherein the telescoping members can each be adjusted in length and angular orientation relative to adjoining members to form a plurality of polygonal shapes.

In these respects, the telescoping polygonal figure according to the present invention substantially departs from the conventional concepts and designs of the prior art, and in so doing provides an apparatus primarily developed for the purpose of positioning into a variety of polygonal orientations.

SUMMARY OF THE INVENTION

In view of the foregoing disadvantages inherent in the known types of adjustable figures now present in the prior art, the present invention provides a new telescoping polygonal figure construction wherein the same can be utilized for positioning into a variety of polygonal shapes. As such, the general purpose of the present invention, which will be described subsequently in greater detail, is to provide a new telescoping polygonal figure apparatus and method which has many of the advantages of the adjustable figures mentioned heretofore and many novel features that result in a telescoping polygonal figure which is not anticipated, rendered obvious, suggested, or even implied by any of the prior art adjustable figures, either alone or in any combination thereof.

To attain this, the present invention generally comprises a figure for positioning into a variety of polygonal orientations. The inventive device includes telescoping outer members pivotally connected to one another to form a polygon. The telescoping members can each be adjusted in length and angular orientation relative to adjoining members to form a plurality of polygonal shapes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new telescoping polygonal figure apparatus and method which has many of the advantages of the adjustable figures mentioned heretofore and many novel features that result in a telescoping polygonal figure which is not anticipated, rendered obvious, suggested, or even implied by any of the prior art adjustable figures, either alone or in any combination thereof.

It is another object of the present invention to provide a new telescoping polygonal figure which may be easily and efficiently manufactured and marketed.

It is a further object of the present invention to provide a new telescoping polygonal figure which is of a durable and reliable construction.

Still another object of the present invention is to provide a new telescoping polygonal figure for positioning into a variety of polygonal shapes.

Yet another object of the present invention is to provide a new telescoping polygonal figure which includes telescoping outer members pivotally connected to one another to form a polygon, wherein the telescoping members can each be adjusted in length and angular orientation relative to adjoining members to form a plurality of polygonal shapes.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
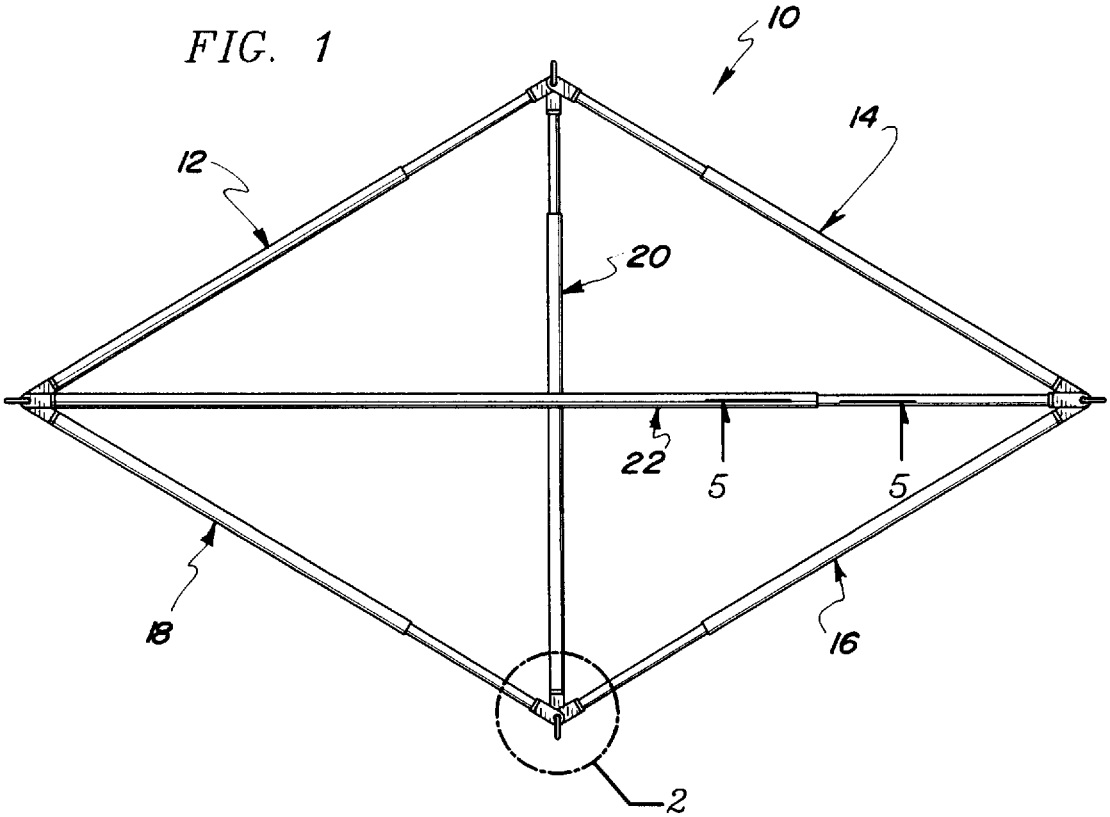
FIG. 1 is a top plan view of a telescoping polygonal figure according to the present invention.

With reference now to the drawings, and in particular to FIGS. 1–7 thereof, a new telescoping polygonal figure embodying the principles and concepts of the present invention and generally designated by the reference numeral 10 will be described.

Figures 6, 7:
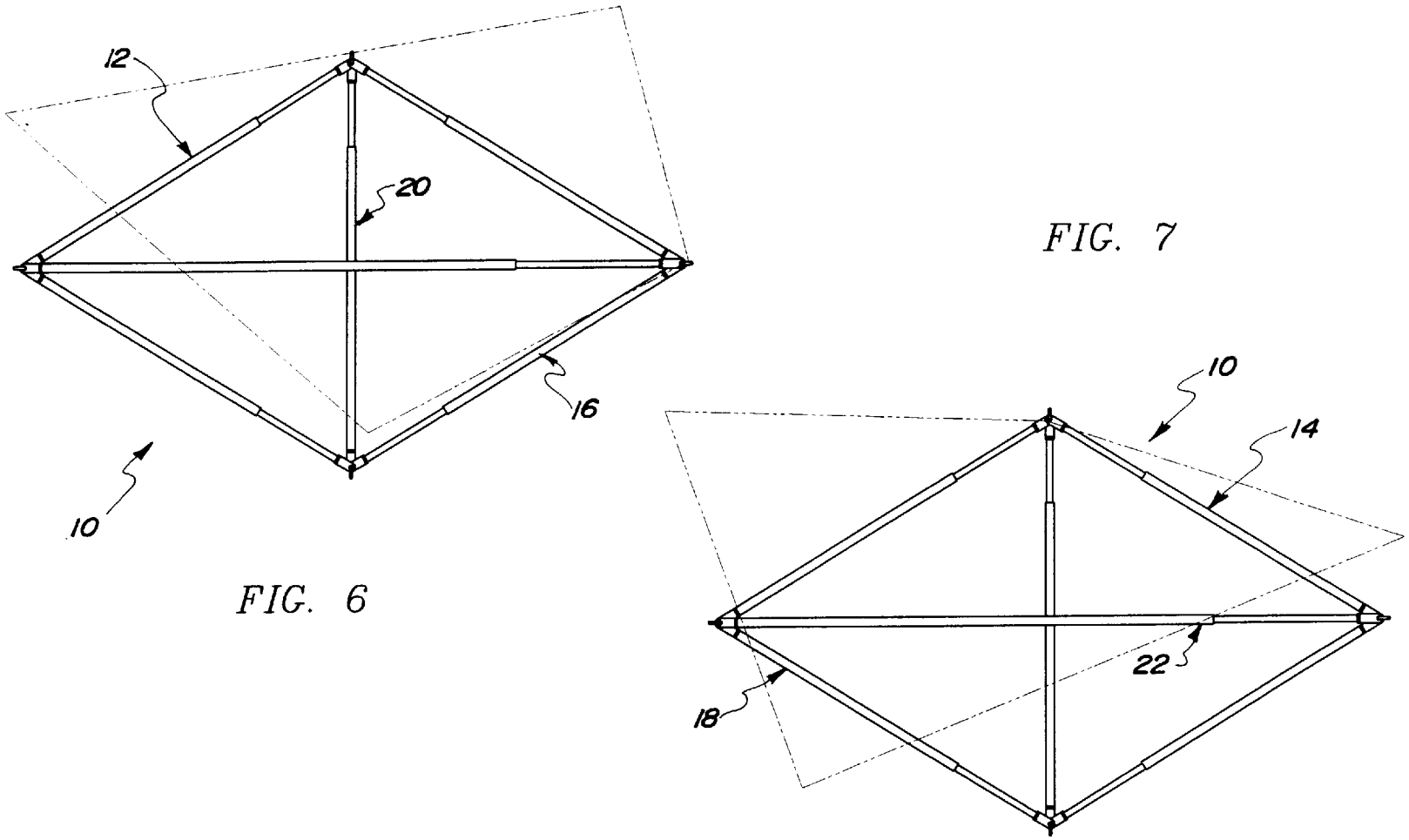
FIG. 6 is a top plan view of the present invention in use.
FIG. 7 is a further top plan view of the invention in use.

More specifically, it will be noted that the telescoping polygonal FIG. 10 comprises a first outer member 12 having first and second ends, and a second outer member 14 also having opposed first and second ends. A first end of the second outer member 14 is pivotally mounted to the second end of the first outer member 12 as shown in FIG. 1 of the drawings. The present invention 10 further comprises a third outer member 16 having first and second ends, with a first end of the third outer member being pivotally connected to a second end of the second outer member 14. A fourth outer member 18 also having respectively opposed first and second ends is pivotally coupled at a first end thereof to the second end of the third outer member 16. The second end of the fourth outer member 18 is pivotally coupled to the first end of the first outer member 12 so as to form a closed polygonal figure as illustrated in FIG. 1 of the drawings. The outer members 12, 14, 16, 18 are each constructed so as to be selectively adjustable in length so as to permit the device 10 to assume any one of a variety of four-sided polygonal shapes as illustrated in FIGS. 6 and 7 of the drawings.

With continuing reference to FIG. 1, it can be shown that the present invention 10 may further comprise a first center member 20 having respectively opposed first and second ends thereof, with the first end of the first center member being pivotally connected to the second end of the first outer member 12 and the first end of the second outer member 14. A second end of the first center member 20 is further pivotally coupled to the second end of the third outer member 16 and the first end of the fourth outer member 18 so as to extend between a juncture of the first and second outer members and a juncture of the third and fourth outer members. Similarly, a second center member 22 having respectively opposed first and second ends thereof can also be provided with the present invention 10. The first end of the second center member 22 is pivotally coupled to the second end of the second outer member 14 and the first end of the third outer member 16, with a second end of the second center member 22 being pivotally coupled to the second end of the fourth outer member 18 and the first end of the first outer member 12 such that the second center member 22 extends between a juncture of the second and third outer members and a juncture of the fourth and first outer members.

Figure 2:
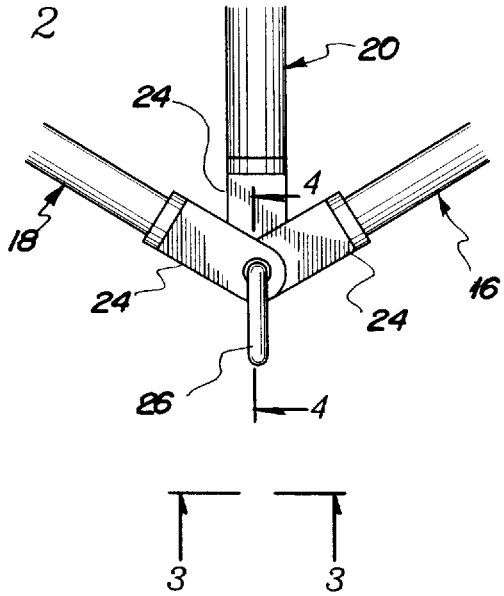
FIG. 2 is an enlarged plan view of the area set forth in FIG. 1.
Figure 3:
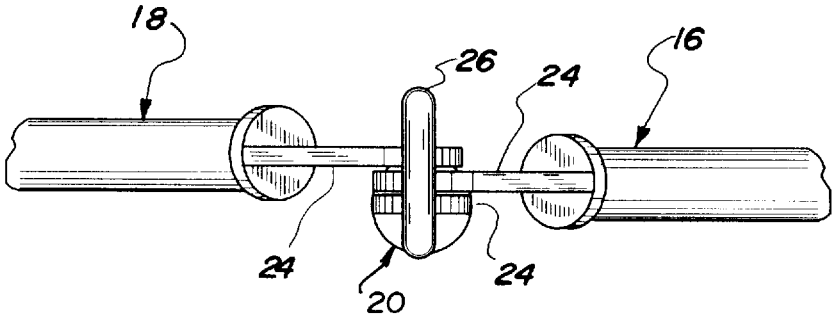
FIG. 3 is an elevation view taken from line 3—3 of FIG. 2.
Figure 4:
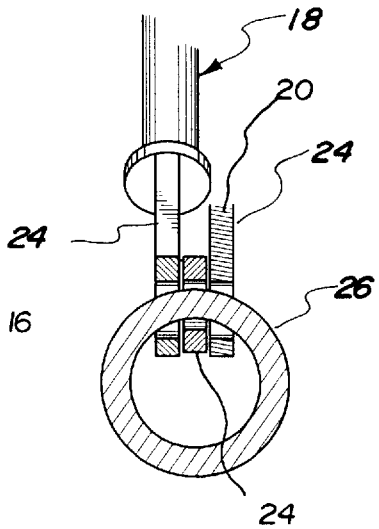
FIG. 4 is a cross sectional view taken along line 4—4 of FIG. 2.

As best illustrated in FIGS. 2 through 4, it can be shown that each of the ends of the members 12, 14, 16, 18, 20, 22 includes an apertured tab 24 extending therefrom, with a wire ring 26 extending through pivotally coupled apertured tabs so as to join the members 12, 14, 16, 18, 20, 22 together as described above.

Figure 5:
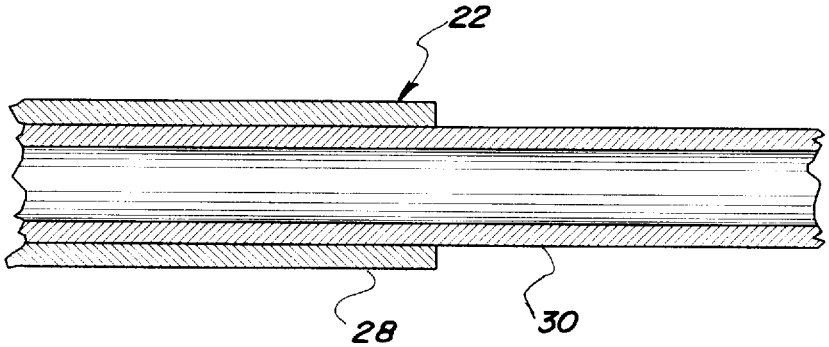
FIG. 5 is a cross sectional view taken along line 5—5 of FIG. 1.

As shown in FIG. 5 for the second center member 22, each of the members 12, 14, 16, 18, 20, 22 preferably comprises a substantially hollow receiving tube 28, with a telescoping member 30 being slidably received therein. Preferably, the telescoping member 30 is dimensioned so as to snugly or frictionally engage an interior of the receiving tube 28. By this structure, each of the members 12, 14, 16, 18, 20, 22 can be selectively elongated and shortened to a desired length during manipulation of the device 10, whereby the frictional engagement between an exterior surface of the telescoping member 30 an interior surface of the receiving tube 28 operates to retain the present invention 10 within the desired orientation.

In use, the telescoping polygonal FIG. 10 according to the present invention can be easily utilized to form various polygonal figures as illustrated in FIGS. 6 and 7 of the drawings. The present invention 10, because of the frictional engagement between the telescoping member 30 and the receiving tube 28 of each of the members 12, 14, 16, 18, 20, 22, will retain a desired polygonal shape subsequent to positioning thereof.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications may be resorted to, falling within the scope of the invention.

What is claimed as being new and desired to be protected by LETTERS PATENT of the United States is as follows:

1. A telescoping polygonal figure comprising:

a first outer member having opposed first and second ends;

a second outer member having opposed first and second ends, with the first end of the second outer member being pivotally mounted to the second end of the first outer member;

a third outer member having opposed first and second ends, with the first end of the third outer member being pivotally connected to the second end of the second outer member;

a fourth outer member having opposed first and second ends, the fourth outer member being pivotally coupled at the first end thereof to the second end of the third outer member, with the second end of the fourth outer member being pivotally coupled to the first end of the first outer member so as to form a closed polygonal figure;

a first center member having respectively opposed first and second ends thereof, the first end of the first center member being pivotally connected to the second end of the first outer member and the first end of the second outer member, with the second end of the first center member being pivotally coupled to the second end of the third outer member and the first end of the fourth outer member so as to extend between a juncture of the first and second outer members and a juncture of the third and fourth outer members; and a second center member having respectively opposed first and second ends, the first end of the second center member being pivotally coupled to the second end of the second outer member and the first end of the third outer member, with the second end of the second center member being pivotally coupled to the second end of the fourth outer member and the first end of the first outer member such that the second center member extends between a juncture of the second and third outer members and a juncture of the fourth and first outer members;

wherein each of the ends of the members includes an apertured tab extending therefrom, with a wire ring extending through an aperture of the apertured tabs so as to join the members together;

wherein each of the members are constructed so as to be selectively adjustable in length to permit the figure to assume any one of a variety of four-sided polygonal shapes and comprise a substantially hollow receiving tube and a telescoping member being dimensioned so as to frictionally engage an interior of the receiving tube such that each of the members can be selectively elongated and shortened to a desired length during manipulation of the device, the frictional engagement between the exterior surface of the receiving tube operating to retain the figure within a desired orientation.

* * * * *